US006157908A

United States Patent [19]

O'Gwynn

[11] Patent Number: 6,157,908

[45] Date of Patent: Dec. 5, 2000

[54] ORDER POINT COMMUNICATION SYSTEM AND METHOD

[75] Inventor: David C. O'Gwynn, Ramona, Calif.

[73] Assignee: HM Electronics, Inc., San Diego, Calif.

[21] Appl. No.: 09/013,574

[22] Filed: Jan. 27, 1998

[51] Int. Cl.[7] ..... G10L 21/02

[52] U.S. Cl. ..... 704/226; 455/570; 381/94.1; 704/208

[58] Field of Search ..... 704/201, 203, 704/208, 226, 209, 205; 455/570, 550, 517, 261, 135; 381/94.1, 94.2, 317

[56] References Cited

U.S. PATENT DOCUMENTS

| | | | |
|---|---|---|---|
| 4,518,994 | 5/1985 | Schnitzler | 348/390 |
| 5,133,013 | 7/1992 | Munday | 704/226 |
| 5,203,017 | 4/1993 | Brooks | 455/54.1 |
| 5,220,677 | 6/1993 | Brooks | 455/53.1 |
| 5,321,848 | 6/1994 | Miyahira et al. | 455/66 |
| 5,432,859 | 7/1995 | Yang et al. | 381/94 |
| 5,479,560 | 12/1995 | Mekata | 704/209 |
| 5,539,859 | 7/1996 | Robbe et al. | 704/233 |
| 5,550,924 | 8/1996 | Helf et al. | 381/94.3 |
| 5,590,407 | 12/1996 | Ishikawa et al. | 455/66 |
| 5,652,770 | 7/1997 | Eatwell . | |
| 5,708,722 | 1/1998 | Forgues et al. | 381/94.1 |
| 5,710,862 | 1/1998 | Urbanski | 704/226 |
| 5,727,072 | 3/1998 | Raman | 381/94.2 |
| 5,768,473 | 6/1998 | Eatwell et al. . | |
| 5,806,025 | 9/1998 | Vis et al. | 704/226 |
| 5,937,377 | 8/1999 | Hardiman et al. | 704/225 |
| 5,963,899 | 10/1999 | Bayya et al. | 704/226 |

*Primary Examiner*—Curtis A. Kuntz
*Assistant Examiner*—Abul K. Azad
*Attorney, Agent, or Firm*—Bernard L. Kleinke; Foley & Lardner

[57] ABSTRACT

An order point communication system and method employs a noise reduction circuit for enhancing the messages communicated to complete an order to improve substantially the speech to noise ratio thereof so that the perceived sound quality is enhanced in noisy environments. The circuit includes a device for separating noise content of portions of the messages, and another device for reconstructing the noise-removed portion of the messages to form a single substantially pure speech signal to serve as a reconstructed message for completing the order.

17 Claims, 3 Drawing Sheets

ORDER POINT COMMUNICATION SYSTEM AND METHOD

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Technical Field

The present invention relates in general to a quick service order placement communication system and method. It more particularly relates to a method and system for communicating between a customer and an order taker in a quick service facility, such as a drive-up restaurant or the like.

2. Background Art

Quick service establishments, such as drive-up restaurants and other facilities, such as banks, gasoline service stations having convenience stores associated therewith, ordinarily employ an order point equipped with a speaker post or similar arrangement, such as a menu board, or the like, where the customer can place an order for a product or a service. An order taker positioned inside of the building for the quick service establishment, can communicate via a communication system with the customer to complete the transaction.

While such communication systems have been satisfactory for many applications, they often times are used out of doors, and such outdoor use of the equipment in noisy environments frequently causes less than satisfactory sound quality. Another example of communication systems used in noisy environments are intercom systems used in large stores, such as warehouse stores or department stores. In such systems, the cashier who is completing sales orders at an order point, is required at times to use the intercom system in a noisy environment where the background noise may interfere with effective communication with other store employees.

Thus, where the order point is located in a noisy environment, the sound quality may be less than desirable and may be, in certain instances, unacceptable. In this regard, the signal-to-noise ratio may be unacceptable, and thus the customer or the employee may experience difficulties in communicating. When difficulty in communications occur, the transactions may not be properly completed, thereby wasting time and money and sometimes a loss of business results.

For example, in an outdoor environment, such as a drive-up restaurant where the customer order point is positioned adjacent to a driveway for the customer's vehicle, engine noise from the vehicle interferes with the transmission of the customer's voice over the order point microphone to the order taker who is attempting to understand the customer when he or she is placing their order. The offending noise from the vehicle includes the engine noise produced by the radiator fan, the engine belts, or the like, which produces a combination of white noise and periodic noise. Also, the muffler of the vehicle engine produces a periodic low frequency noise.

Additionally, street noise can also add to the unwanted background noise during the order placement. The street noise can include a multiple number of noises from different vehicle engines, as well as the sound of the tires of the vehicles traveling across the pavement.

Therefore, it would be highly desirable to have a new and improved order point communication system and method, which improve greatly the signal-to-noise ratio. It is desirable to enhance significantly the sound quality of the communication messages. By so doing, a more clear and understandable communication would result. A more accurate completing of the transaction can then take place, and thus costly mistakes can be avoided.

SUMMARY OF THE INVENTION

Therefore, the principal object of the present invention is to provide a new and improved order point communication system and method, which greatly improve the signal-to-noise ratio of the messages communicated during the completion of a transaction.

Another object of the present invention is to provide such a new and improved order point communication system and method, which greatly enhance the sound quality of the communication of the messages to facilitate more accurate filling of orders.

Briefly, the above and further objects of the present invention are realized by providing a new and improved order point communication system and method, which includes a noise reduction circuit.

An order point communication system and method employs a noise reduction circuit for enhancing the messages communicated to complete an order to improve substantially the speech to noise ratio thereof so that the perceived sound quality is enhanced in noisy environments. The circuit includes a device for separating noise content of portions of the messages, and another device for reconstructing the noise-removed portion of the messages to form a single substantially pure speech signal to serve as a reconstructed message for completing the order.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

DETAILED DESCRIPTION

Figure 1:
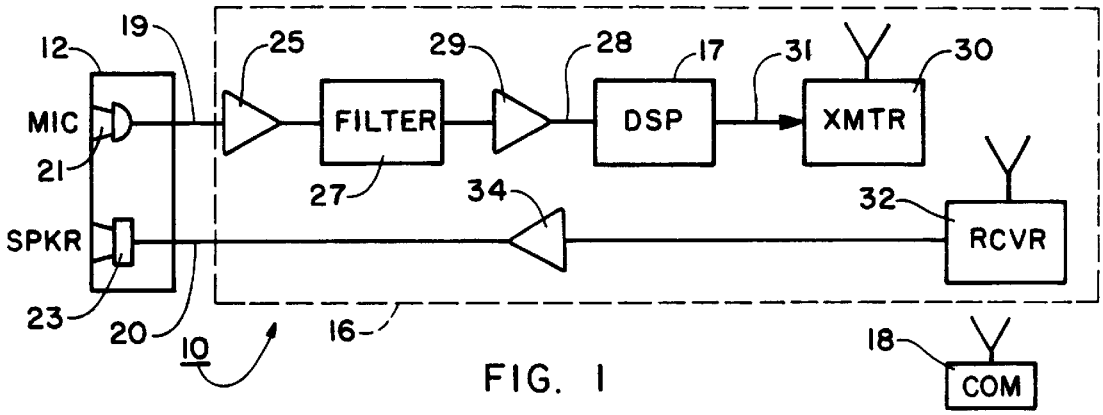
FIG. 1 is a block diagram of an order point communication system which is constructed in accordance with the present invention.
Figure 5:
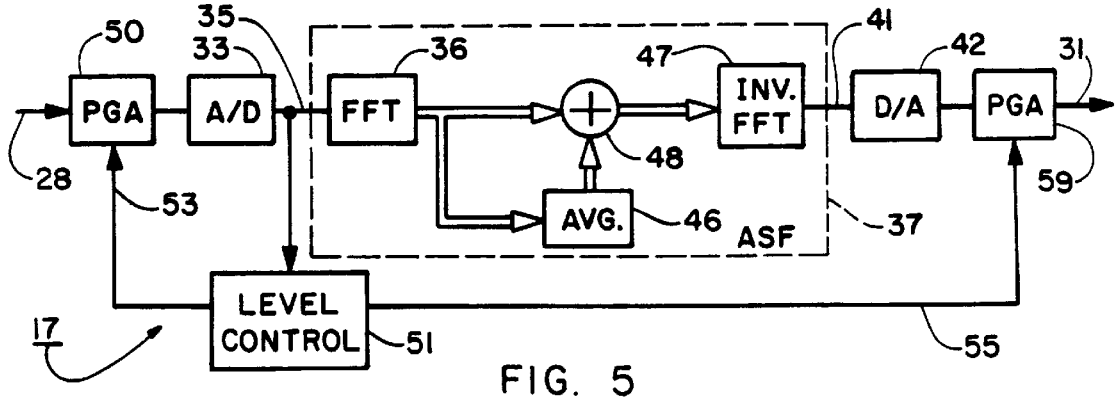
FIG. 5 is a symbolic block diagram of a noise reduction circuit of the system of FIG. 1.

Referring now to FIGS. 1 and 5 of the drawings, there is shown an order point communication system 10, which is constructed in accordance with the present invention. The system 10 may be used in various quick service facilities, such as drive-up restaurants, banks, gasoline service station having a convenience store associated therewith, and other such facilities. It is also to be understood that the system 10, as well as the other inventive systems disclosed herein, are adapted to be used totally indoors, as well, for the communication of messages to complete sales transactions in a store, such as a warehouse store or a department store, The following descriptions of various embodiments of the invention are by way of example only, and assume that this inventive system is employed in a quick service drive-up restaurant environment. However, it is to be understood that the inventive system may be employed in a variety of different order point facilities as mentioned previously.

The system 10, when employed in a quick service drive-up restaurant environment, includes a customer menu board or speaker post 12 serving as an order point, which may be mounted or positioned for access by a customer. In a drive-up facility (not shown), the speaker post or menu board may be placed adjacent to a driveway (not shown) for enabling the customer to park his or her vehicle (not shown) temporarily adjacent to such an order point so that the customer can place an order while seated within the vehicle.

The system 10 includes a base station unit generally indicated at 16 which relays messages between the customer and the order taker. The base station unit 16 includes a noise reduction circuit 17 in the form of a digital signal processor as hereinafter described in greater detail, for enabling incoming messages from the customer to have an enhanced sound quality.

The system 10 includes an order taker communicator unit 18, which in the preferred form of the invention communicates by wireless radio communication with the base station unit 16. Typically, the base station unit 16 is disposed inside the building (not shown) of the business, and is connected by conductors 19 and 20 to the speaker post 12. The communicator unit 18 is usually worn by the order taker who is able to walk freely about the interior of the facility to assist in the placement of the order received from the customer.

Considering now the speaker post 12 in greater detail, the post 12 includes a microphone 21 with its axis directed toward the customer. A speaker 23 is also directed toward the customer so that the customer can send an order message via the microphone 21 to the order taker. Communication messages from the order taker are communicated to the customer via the speaker 23.

Considering now the base station unit 16 in greater detail, the unit 16 includes an incoming channel which includes an amplifier 25 connected via the conductor 19 to the microphone 21. A filter 27 interconnects the amplifier 25 to another amplifier 29, which in turn supplies the audio signal received from the customer to the noise reduction circuit 17 via a conductor 28. A conductor 31 supplies the enhanced sound quality output from the noise reduction circuit 17 to a wireless transmitter 30 for sending the message to the communicator unit 18 via wireless radio frequency or optical transmission.

The base unit 16 also includes an outgoing audio channel which includes a receiver 32 which is adapted to receive a wireless signal from the communicator unit 18 from the order taker and supplies the signal via an amplifier 34 to the conductor 20 for energizing the speaker 23 at the speaker post 12.

Considering now the noise reduction circuit 17, the circuit 17 is preferably a digital signal processor in the form of a chip set marketed under the trade name CLEARSPEECH by Noise Cancellation Technologies, Inc., having a place of business at Linthicum, Md. The inventive noise reduction circuit 17 in the form of a digital signal processor, enhances the messages communicated from the customer to the order taker in the incoming channel to improve substantially the speech to noise ratio thereof. As a result, the perceived sound quality is greatly enhanced in noisy environments, such as where the speaker post 12 is disposed out of doors.

Figure 2:
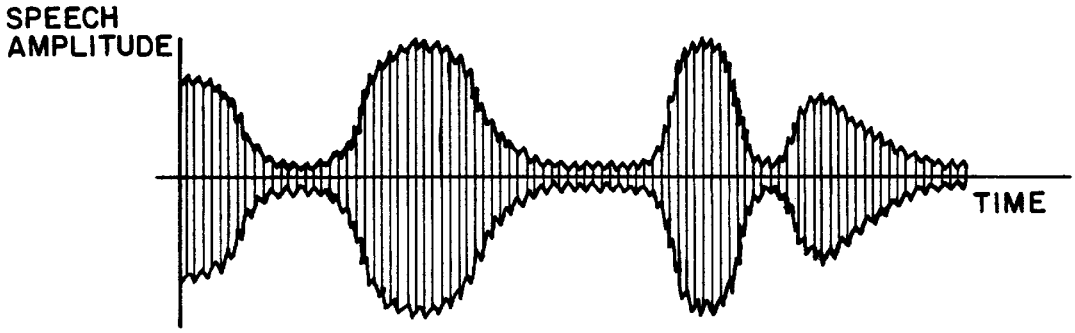
FIGS. 2, 3 and 4 are graphs which are useful in understanding the present invention.
Figure 3:
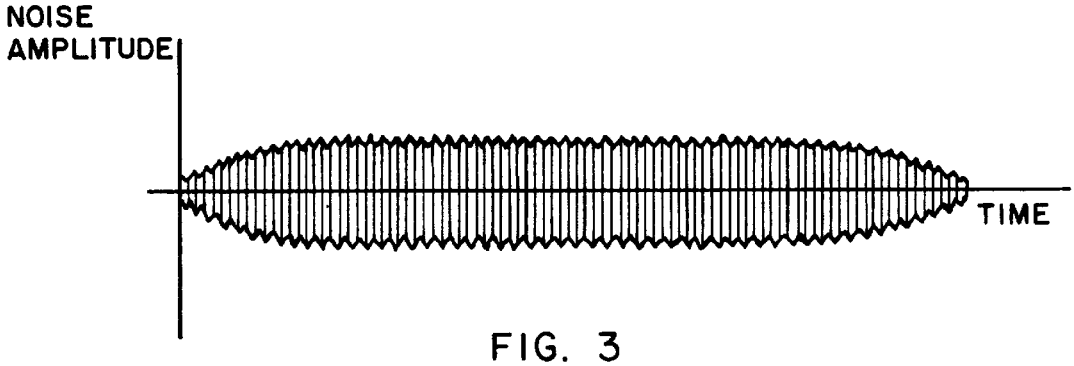
Figure 4:
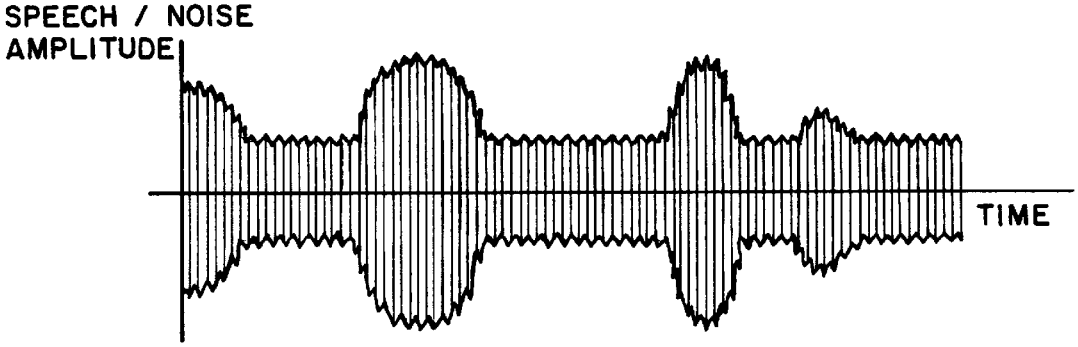

To understand the operation of the circuit 17, reference should be made to FIGS. 3 and 4 to help understand the typical speech and background noise encountered by the system 10. As indicated in FIG. 2, a pattern of substantially pure speech has a widely varying amplitude envelope. As indicated in FIG. 3, the amplitude of typical background noise encountered by the system 10 in a quick service order placement environment or other noisy environment has a substantially constant amplitude envelope. The reason for the constant amplitude of the noise envelope is that the noise is usually generated by the vehicle radiator fan, engine muffler or other engine component, when the order point of the system 10 is used in an outdoor drive-up configuration. Such noises are continuous in nature and thus have a uniform amplitude envelope with time.

When the pure speech signal of FIG. 2 is impressed on the background noise signal of FIG. 3, the combination of speech and noise signal of FIG. 4 is produced. Thus, it is apparent that when a conventional communication system is confronted with such a combination of speech and noise signal as indicated in FIG. 4, it is difficult to discriminate the speech signal from the noise signal since any incremental portion of the signal could be either pure speech or pure noise or a combination of the two. Initially, in typical quick service outdoor environments, the signal-to-noise ratio is frequently far less than desirable, and thus the customer and order taker experience difficulties in communicating and understanding one another. Thus, unwanted mistakes can be made in filling the orders.

Referring now to FIG. 5, the noise reduction circuit 17 is a spectral subtraction circuit and includes an analog to digital converter 33 to convert the incoming analog signal received over the conductor 28 into a digital signal on the conductor 35. The digital signal on the conductor 35 is then applied to a fast Fourier transform circuit 36 which continuously performs a Fourier analysis on the incoming signal received over the conductor 28 to help remove noise content of portions of the messages as they are being received. In this regard, the incoming message is converted by the fast Fourier transform circuit 36 into a group of individual signals, each one of which has a different frequency The circuit 36 generates a large number, such as 256, different component signals, each having a different frequency. It should be understood that other numbers of frequency components would also be acceptable.

The fast Fourier transform circuit 36 is a part of an adaptive speech filter 37, which includes an inverse fast Fourier transform circuit 47 to convert the signals into a substantially pure digital speech signal on a conductor 41 to serve as a reconstructed message which is supplied in amplified form to the conductor 31.

The adaptive speech filter 37 includes an averaging circuit 46 and a summing circuit 48. The averaging circuit 46 determines the average of the amplitudes of each one of the separate frequency components from the fast Fourier transform circuit 36. The averaging circuit 46 determines the rate of change of amplitude for each separate frequency component to determine the quantity of the speech content. In this regard, speech has a dramatic change in loudness as indicated in FIG. 2. The circuit 46 determines the average amplitude for each different frequency component for a given period of time. If the average does not vary widely over the interval of time, the circuit 46 determines that the frequency component is substantially all noise. The circuit 46 then causes the summing circuit 48 to reject that frequency component so that it does not permit it to be supplied to the inverse fast Fourier transform circuit 46.

If the averaging circuit 46 determines that a given frequency component does vary substantially over a predetermined interval of time, the circuit 46 determines that it has a substantial speech component. The component is then passed via the summing circuit 48 under the control of the averaging circuit 46 to the inverse fast Fourier transform circuit 47. It should be understood that the averaging circuit 46 can also determine the estimated percentage of the speech to the noise content in accordance with its variation in amplitude over the predetermined time interval so that a weighted percentage can be passed via the circuit 48 to the inverse fast Fourier transform circuit 47 to more closely approximate the resulting pure speech by means of the inverse fast Fourier transform circuit 47 as supplied on the conductor 41. A digital to analog converter 42 reconstructs an analog speech signal to serve as a reconstructed message which is supplied in amplified form to the conductor 31.

Since the incoming analog signal on the conductor 28 can vary somewhat in a range of amplitudes beyond the limitations of the analog to digital converter 33, an input programmable gain amplifier 50 amplifies the incoming analog signal on the conductor 28 and supplies it to the analog to digital converter 33. The gain of the amplifier 50 is set at a high level, and if the output of the analog to digital converter 33 is clipped or reaches its maximum for a given signal amplitude, a level control circuit 51 responds to the analog to digital circuit 33 and generates a signal and supplies it on a conductor 53 to the amplifier 50 to reduce the gain incrementally. Should the incoming signal remain at that level, the level control circuit 51 continues to decrement the gain of the amplifier 50. Once the incoming analog signal stabilizes at an amplitude within the range of the analog to digital converter 33, the level control circuit 51 will maintain the gain for the amplifier 50 at that level. Should the level of the incoming analog signal increase at a later time, the level control circuit 51 can increment the gain of the amplifier 50 accordingly.

An output programmable gain amplifier 59 is connected between the output digital to analog circuit 42 and the conductor 31 so that the level control circuit 51 can either increment or decrement the gain of the programmable gain amplifier 59 via a conductor 55 to match in an inverse manner the changes in the gain of the input programmable gain amplifier 50. In this regard, should the gain on the amplifier 50 be decremented due to a very loud incoming analog signal, the gain on the output amplifier 51 is incremented by the same amount to return the reconstructed analog signal on the conductor 31 to its original loud condition.

Figure 6:
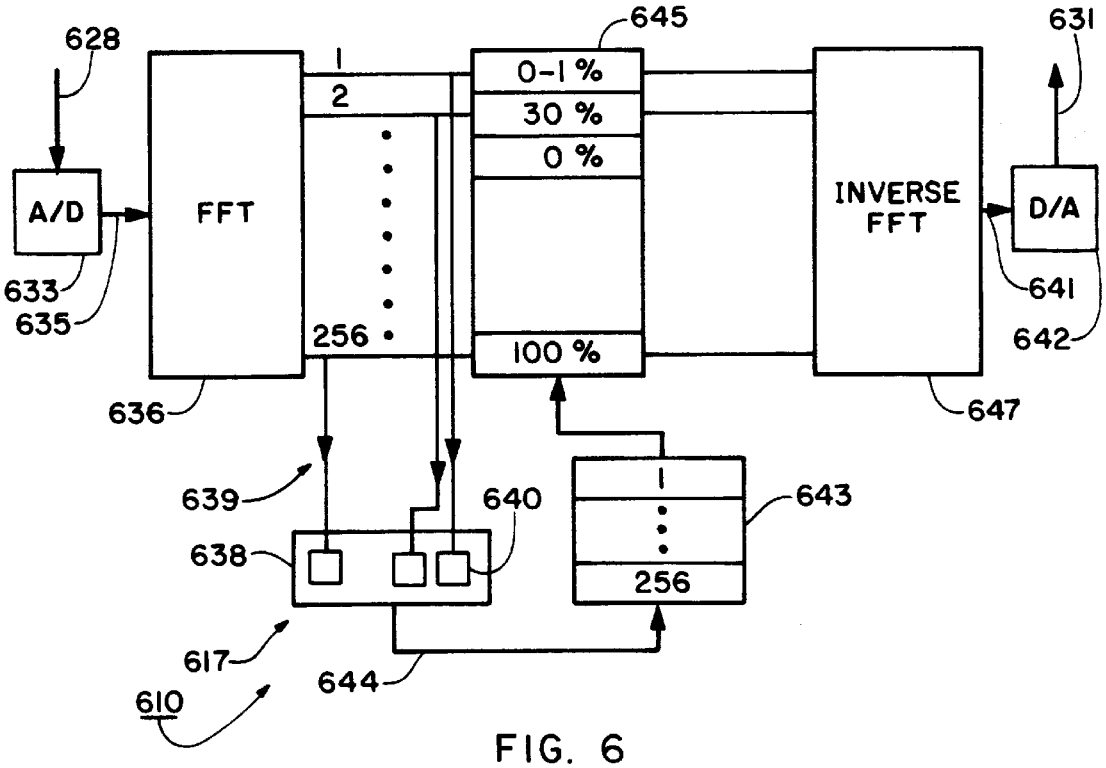
FIG. 6 is a block diagram of an order point communication system, which is constructed in accordance with the present invention.

Referring now to FIG. 6, there is shown an order point communication system 610, which is constructed in accordance with the present invention. The system 610 is generally similar to the system 10 of FIG. 1, except that the noise reduction circuit 17 is replaced with a noise reduction circuit 617, which is also a spectral subtraction circuit. The noise reduction circuit 617 is also a spectral subtraction or separation circuit and includes an analog to digital converter 633 to convert the incoming analog signal recovered over the conductor 628 into a digital signal on the conductor 635. The digital signal on the conductor 635 is then applied to a fast Fourier transform circuit 636 which continuously performs a Fourier analysis on the incoming signal received over the conductor 628 to help remove noise content of portions of the messages as they are being received. In this regard, the incoming message is converted by the fast Fourier transform circuit 636 into a group of individual signals, each one of which has a different frequency. The circuit 636 generates 256 different component signals, each having a different frequency. It should be understood that other numbers of frequency components would also be acceptable. The individual signals are sent to a frequency storage bin circuit 638 via a group of conductors generally indicated at 639. The frequency storage bin circuit 638 includes a group of individual storage bin elements, such as the element 640, which stores the first signal of a given frequency. In this manner, the individual component frequencies of the signals can be analyzed, to discriminate the speech signal from the background noise signal.

A decision-making circuit 643 receives the information from the frequency storage bin circuit 638 and then transfers the information to a weighting circuit 645 as hereinafter described in greater detail. An inverse fast Fourier transform circuit 647 then converts the weighted signals from the circuit 645 into a single substantially pure digital speech signal 641. A digital to analog converter 642 reconstructs an analog speech signal to serve as a reconstructed message which is supplied over the conductor 631. The circuits 638 and 644 determine the rate of change of amplitude for given bin elements, such as the element 640, to determine the quantity of the speech content. The circuit 643 then determines an average of all of the bin elements for the frequency signals. Thereafter, the circuit 643 computes the percentage of deviation of each bin signal from the computed average. For example, as indicated in FIG. 6, the first signal is determined to have a weighted average of between zero and one percent speech. The second signal is determined to have 30% speech to signal ratio. The signal 256 is determined to have a 100% speech to signal ratio, and thus this frequency component is substantially pure speech. Thus, the circuit 645 weighs the signal components and transfers the weighted signals to the inverse circuit 647.

Thus, the circuit 643 determines the rate of change of amplitude for each frequency signal to identify the variation in amplitude. The circuits 640 and 643 then average the rate of amplitude change for all of the frequency signals to assign a weighted value for each signal indicative of the speech to signal values therefor. Thereafter, the inverse circuit 647 converts the weighted signals into a single substantially pure speech signal to serve as a reconstructed message.

Figure 7:
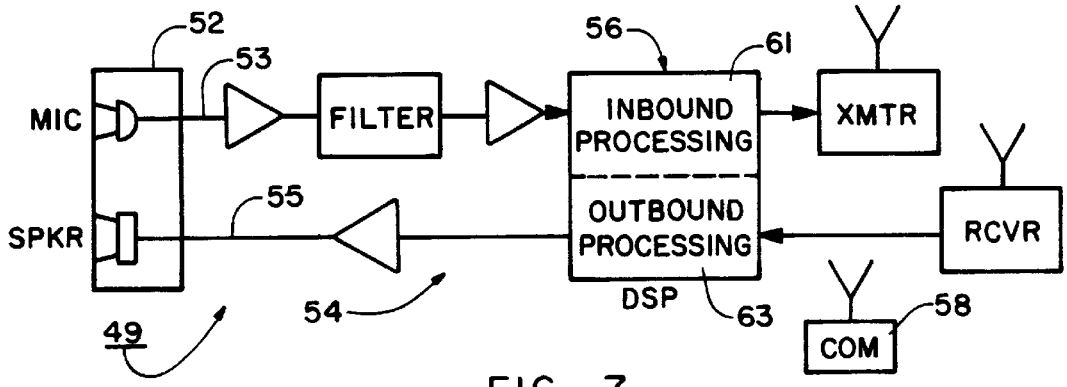
FIG. 7 is a block diagram of another order point communication system, which is constructed in accordance with the present invention.

Referring now to FIG. 7, there is shown an order point communication system 49, which is constructed in accordance with the present invention. The system 49 is similar to the system 10, except that the system 49 includes noise reduction for both the incoming and outgoing channels.

The system 49 includes a customer speaker post 52, which is connected via a pair of conductors 53 and 55 to the incoming and outgoing channels, respectively, of a base station unit 54 which communicates with an order taker communicator unit 58. The base station unit 54 includes a noise reduction circuit 56, which operates in a generally similar manner as the noise reduction circuit 17 of FIG. 5. However, the circuit 56 includes both an inbound processing portion 61 and an outbound processing portion 63 to enhance the signal quality for both the messages emanating from the customer and from the order taker.

Figure 8:
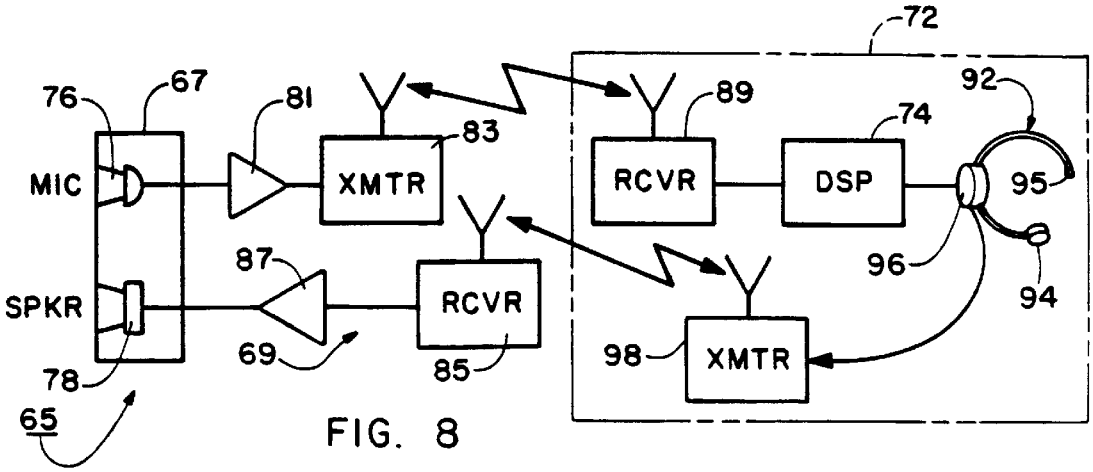
FIG. 8 is a block diagram of yet another order point communication system, which is constructed in accordance with the present invention.

Referring now to FIG. 8, there is shown an order point communication system 65, which is constructed in accordance with the present invention. The system 65 is generally similar to the system 10, except that the noise reduction is accomplished in an order taker communicator unit 72 instead of in the base station unit 69. The system 65 includes a customer speaker post 67 connected in communication with the base station unit 69, which in turn communicates via a wireless communication path with the order taker communicator unit 72. The communicator emit 72 includes a noise reduction circuit 74, which is similar to the noise reduction circuit 17 of the system 10.

The speaker post 67 includes a microphone 76 and a speaker 78. The base station unit 69 has an incoming channel which includes an amplifier 81 interconnecting the microphone 76 to a transmitter 83 for communicating with the communicator unit 72. The base station unit 69 includes an outgoing channel having a receiver 85 for receiving wireless communications from the communicator unit 72 and supplying it through an amplifier 87 to the speaker 78 of the speaker post 67.

The communicator unit 72 includes a receiver 89 for wireless communication with the transmitter 83 of the base station unit 69 to supply an audio signal to the noise reduction circuit 74, which is a digital signal processor for increasing the signal to noise ratio as hereinafter described in connection with the description of the circuit 17 of FIG. 5. The headset 92 is adapted to be worn by the order taker and has an earphone speaker 94 and a microphone 95. A microphone circuit 96 communicates with a transmitter 98 for wireless communication with the receiver 85 of the base station unit 69.

Figure 9:
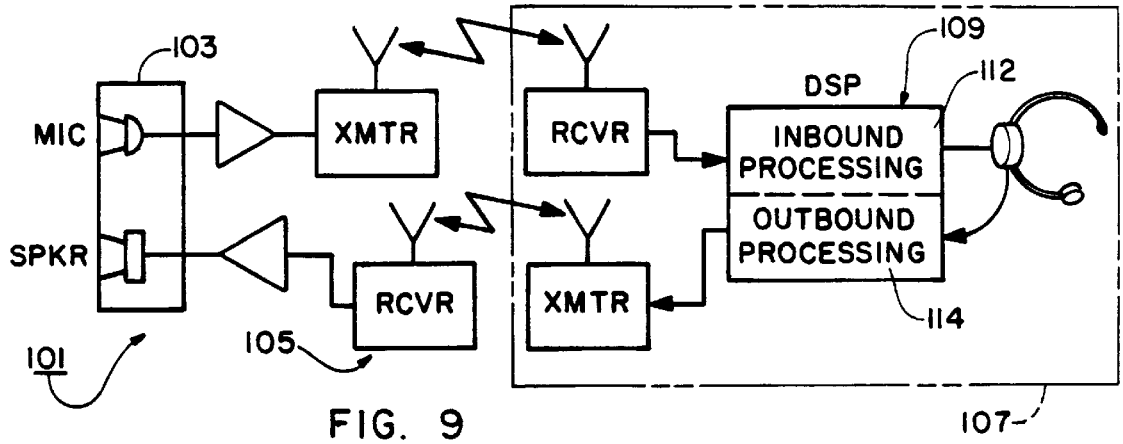
FIG. 9 is a block diagram of still another order point communication system, which is constructed in accordance with the present invention.

Referring now to FIG. 9, there is shown another order point communication system 101, which is constructed in accordance with the present invention. The system 101 is similar to the system 10 of FIG. 1, except that the communicator unit includes noise reduction in both the incoming and outgoing channels. The system 101 includes a customer speaker post 103 which is connected in communication with a base station unit 105 in a similar manner as the speaker post and the base station are interconnected in the system 65 of FIG. 7. An order taker communicator unit 107 is similar to the communicator unit 72 of FIG. 8, except that it includes a noise reduction circuit 109, which includes an inbound processing circuit 112 and an outbound processing circuit 114 to enhance the quality of the audio signal in both the inbound message from the customer and an outbound message from the order taker as described in connection with the noise reduction circuit 17 of FIG. 5.

Figure 10:
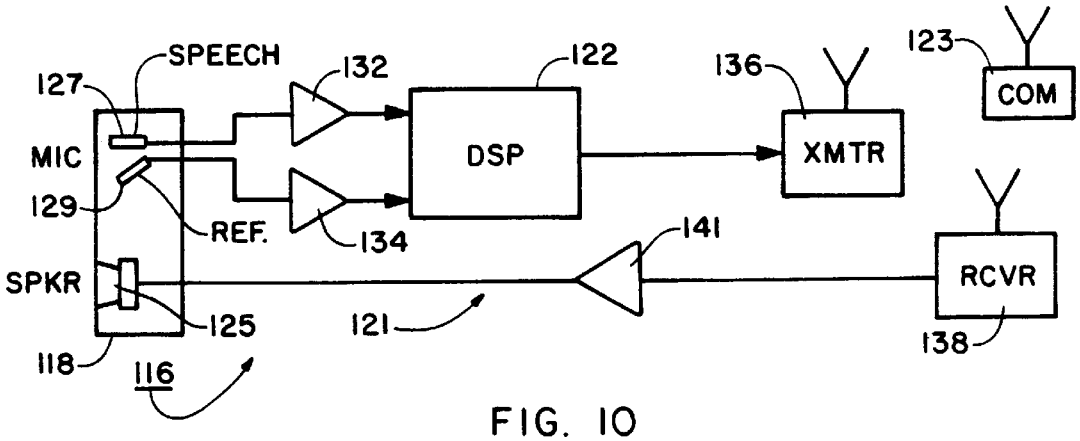
FIG. 10 is a block diagram of a further order point communication system, which is constructed in accordance with the present invention.

Referring now to FIG. 10, there is shown an order point communication system 116, which is constructed in accordance with the present invention. The system 116 is similar to the system 10, except that the noise reduction is accomplished in a slightly different manner, and the speaker post microphone arrangement is somewhat different to facilitate the noise reduction operation. The system 116 includes a customer speaker post 118 which is connected in communication with a base station unit 121, which includes a noise reduction circuit 122, in the form of a digital signal processor as hereinafter described in greater detail. An order taker communicator unit 123 communicates by wireless radio communication with the base station unit 121.

Considering now the speaker post 118 in greater detail, the speaker post 118 includes a speaker 125. Also, the speaker post 118 includes a speech microphone 127 directed toward the customer (not shown). A reference microphone 129 is directed away from the customer and is adapted to receive background noise to help discriminate the speech from the background noise.

The base station unit 121 includes a speech amplifier 132 and a reference amplifier 134 connected respectively to the speech microphone 127 and the reference microphone 129 for supplying signals from the two microphones to the noise reduction circuit 122. The noise reduction circuit 122 subtracts the noise component of the incoming message from the speech component thereof. In this regard, the digital signal processor 122 utilizes a least mean square error algorithm to achieve the subtraction operation. The resulting signal is supplied to a transmitter 136, which communicates by wireless communication path to the communicator unit 123. A receiver 138 receives message signals from the communicator 123 and supplies them through an amplifier 141 to the speaker 125.

The least mean square algorithm is a conventional mathematical algorithm. It is self adapting, and adjusts itself over time to minimize the error (the difference between the speech signal and the noise signal).

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. An order point communication system, comprising:

an order point being disposed in a location subject at times to undesirable audible background noise and having microphone means and speaker means for communicating message for completing transactions;

a base station unit for relaying messages to and from the order point;

a wireless communicator unit having microphone means and speaker means for communicating wirelessly messages via the base station unit to and from the order point; and means for enhancing relative to the audible background noise the messages being generated at the order point before receipt by said communicator unit to improve substantially the speech to noise ratio thereof that the perceived sound quality at said communicator unit of the messages sent from the order point is enhanced in noisy environments;

the message enhancing means having an input and an output;

means coupling said input of said message enhancing means and the order point microphone in communication with one another;

said message enhancing means including means for separating noise content, indicative of the background noise at the order point, from the messages originated from said order point;

means for reconstructing the noise-removed portions of the messages to form a single substantially pure speech signal to serve as a reconstructed message at the communicator unit; and means for coupling said output of said message enhancing means and said wireless communicator unit to supply the reconstructed message thereto;

wherein said noise reduction means includes means for converting one of said messages into a group of individual signals of different frequencies, means for determining the rate of change of amplitude for each signal to identify the variation in amplitude, means for averaging the rate of amplitude change for all of the signals to assign a weighted value for each signal indicative of the speech to noise values therefor, and means for converting the weighted signals into a single substantially pure speech signal to serve as a reconstructed message.

2. An order point communication system according to claim 1, wherein said noise reduction means includes an adaptive speech filter means for special subtraction of the noise component of portions of the messages.

3. An order point communication system according to claim 1, wherein said base station unit includes said noise reduction means.

4. An order point communication system according to claim 1, wherein said order taken communicator unit includes said noise reduction means.

5. An order point communication system according to claim 1, wherein said noise reduction means enhances one channel of message communication only.

6. An order point communication system according to claim 1, wherein said noise reduction means enhances both channels of message communication.

7. An order point communication system according to claim 1, wherein said means for converting includes fast Fourier transform means.

8. An order point communication system according to claim 1, wherein said means for converting the weighted signal includes an inverse Fourier transform means.

9. An order point service communication system according to claim 1, wherein the speaker post microphone means includes a plurality of microphones for receiving speech messages and background noise.

10. An order point communication system according to claim 9, wherein the speaker post microphone means includes a speech microphone for the customer and a reference microphone for background noise, and means for comparing the audio signals from said microphones to reconstruct a signal substantially pure speech signal to serve as a reconstructed message.

11. An order point communication system according to claim 10, wherein said means for comparing includes processor means for calculating at least mean square algorithm.

12. A method of order communication comprising:

using an order point mounted in a location subject at times to undesirable audible background noise for detecting by a first microphone order messages and enunciating by a first speaker response messages to help complete a transaction;

using a base station unit for respectively relaying order and response messages from and to the order point;

using a wireless communicator unit having a second speaker and a second microphone for wireless communicating order and response messages via the base station unit respectively from and to the order point to complete a customer transaction;

digitally enhancing the order messages being generated at the order point before receipt by said communicator unit to improve substantially the speech to noise ratio thereof so that the perceived sound quality at said communicator unit of the messages sent from the order point is improved;

analog-to-digital converting and digitally frequency decomposing the order messages and suppressing separated noise components indicative of the background noise at the order point; and recombining and analog-to-digital converting the remaining portions of the messages to form a single substantially pure speech signal to serve as a reconstructed message at said communicator unit for completing the transaction to thereby improve substantially the speech to noise ratio thereof so that the perceived sound quality at said communicator unit of the message sent from said order point despite the noisy environment thereat is enhanced;

wherein said separating includes converting one of said messages into a group of individual signals of different frequencies, determining the rate of change of amplitude for each signal to identify the variation in amplitude, and averaging the rate of amplitude change for all of the signals to assign a weighted value for each signal indicative of the speech to noise values therefor.

13. A method according to claim 12, wherein said reconstructing includes converting the weighted signals into the single substantially pure speech signal.

14. A method according to claim 12, wherein said reconstructing includes performing a fast Fourier transform.

15. A method according to claim 14, where said reconstructing includes performing an inverse Fourier transform.

16. A method according to claim 12, wherein said separating includes converting one of said messages into a group of individual signals of different frequencies, determining the rate of change of amplitude for each signal to identify the variation is amplitude, and passing only through frequencies having a sufficiently great rate of change of amplitude.

17. A digitized, noise suppressing order point communication system, comprising:

an order point installable in a location subject at times to undesirable audible background noise and having first microphone means and first speaker means for respectively communicating order and response messages for completing transactions;

a base station unit for respectively relaying order and response messages from and to the order point;

a wireless communicator unit having second microphone means and second speaker means for respectively communicating wirelessly response and order messages via the base station unit to and from the order point;

means for enhancing the order messages being generated at the order point before receipt by said second speaker to improve substantially the speech to noise ratio thereof so that the perceived sound quality at said communicator unit of the order messages is substantially less noisy;

means coupling the message enhancing means and the first microphone in communication with one another;

said speech enhancing means including means for analog-to-digital converting and digitally frequency decomposing the order messages, identifying and digitally suppressing noisy frequency components indicative of the background noise at the order; and means for recombining and analog-to-digital converting the remaining frequency components of the order messages to form a single substantially pure speech signal to serve as a reconstructed message at the communicator unit;

wherein said noise reduction means includes means for converting one of said messages into a group of individual signals of different frequencies, means for determining the rate of change of amplitude for each signal to identify the variation in amplitude, means for averaging the rate of amplitude change for all of the signals to assign a weighted value for each signal indicative of the speech to noise values therefor, and means for converting the weighted signals into a single substantially pure speech signal to serve as a reconstructed message.

* * * * *